US006254499B1

(12) United States Patent
Tarleton

(10) Patent No.: US 6,254,499 B1
(45) Date of Patent: Jul. 3, 2001

(54) DOUBLE STRINGED TENNIS RACQUET WITH GROMMET INSERT

(76) Inventor: Barry A. Tarleton, 1525 Aviation Blvd., #C374, Redondo Beach, CA (US) 90278

( * ) Notice: Subject to any disclaimer, the term of this patent is extended or adjusted under 35 U.S.C. 154(b) by 0 days.

(21) Appl. No.: 09/618,071

(22) Filed: Jul. 17, 2000

Related U.S. Application Data

(60) Provisional application No. 60/145,020, filed on Jul. 22, 1999.

(51) Int. Cl.[7] ..... A63B 51/06
(52) U.S. Cl. ..... 473/533
(58) Field of Search ..... 473/540, 543, 473/524, 533

(56) References Cited

U.S. PATENT DOCUMENTS 3,904,202 * 9/1975 DeLorean ..... 473/533 X
3,968,966 * 7/1976 D'Aquanni ..... 473/533
4,049,269 * 9/1977 Blackburne ..... 473/533
4,204,680 * 5/1980 Blackburne ..... 473/533
4,320,900 * 3/1982 Blackburne ..... 473/533
5,423,532 * 6/1995 Huang ..... 473/533
5,467,982 * 11/1995 Tseng ..... 473/540
5,743,822 * 4/1998 Tarleton ..... 473/533

FOREIGN PATENT DOCUMENTS

3924674 * 12/1989 (DE) ..... 473/FOR 178
2239809 * 7/1991 (GB) ..... 473/FOR 178

* cited by examiner

*Primary Examiner*—Raleigh W. Chiu
(74) *Attorney, Agent, or Firm*—Roger A. Marrs

(57) ABSTRACT

A tennis racquet with a holeless oval frame head with front and back faces provided with a continuous outside groove and with spaced-apart recessed transverse cuts in each face occupied by a portion of a continuous string. The edge groove is interconnected with the transverse cuts and a continuous grommet is insertably received in the outside edge groove and is secured in place. The grommet has spaced-apart slots in co-extensive alignment with an edge marginal groove having a plurality of spaced apart projections which include an undercut channel conformal with the curvature of the string. A double stringed bed is provided with the string trained about both faces of the head in a recessed position so that the strings of the bed are substantially coplanar across the bed surfaces and slightly above the front and back faces of the frame head.

9 Claims, 2 Drawing Sheets

DOUBLE STRINGED TENNIS RACQUET WITH GROMMET INSERT

Priority claimed on Ser. No. 60-145,020 filed Jul. 22,1999

BACKGROUND OF THE INVENTION

1. Field of the Invention

The present invention relates to the game of tennis, and more particularly to a novel tennis racquet provided with a double string bed having the string of the racquet substantially coplanar with the respective front and back faces of the frame head and incorporating a grommet insert for retaining the double string bed in place.

2. Brief Description of the Prior Art

Conventional tennis racquets are provided with a single string bed of overlapped longitudinal and transverse strings stretched between and across the opening of the racquet frame head. With this conventional stringing arrangement, tennis balls striking the frame of the racquet cannot be returned with the accuracy normally obtainable where the tennis ball strikes the main portion of the string bed. In such instances, the tennis ball travels in an uncontrolled manner and at wide angles not intended by the player.

Some attempts have been made to avoid this problem by stringing the racquet head with a double string bed so that the frame head of the racquet is less exposed to impacting with the tennis ball. However, such prior attempts to provide a double string bed involved the drilling of holes through the frame itself or by employing a plurality of tubes into which the string was inserted as it passed through the frame. In other instances, additional clips, clamps and screws for retention have been used. However, the strings are not above the front and back surfaces of the racquet head so that accuracy is still seriously compromised. Such prior double string bed racquets are disclosed in U.S. Pat. Nos. 5,443,575; 5,467,982; 5,192,072; 4,141,549 and 4,320,900. Still a further disclosure is included in U.S. Pat. No. 5,743,822. All of the disclosures in these patents suffer from employment of tubes, holes in the frame or special retaining devices, and in most instances, the strings crossing the front and back faces of the frame are fully unexposed and non-coplanar with the surface of the faces. Also, problems have been encountered which deal with producing a one-piece frame with undercuts and grooves such as disclosed in U.S. Pat. No. 5,743,822

Therefore, a long-standing need has existed to provide a tennis racquet provided with a double string bed wherein one bed is looped over the front face of the tennis racquet frame while the other string bed is looped over the rear or back face of the frame. It is best to have the ability to string the bed onto the frame head of the racquet without the use of tubes or holes so that the structural integrity of the frame head is not adversely affected. With such an arrangement, it is believed that maximum control of the tennis ball can be achieved even when the ball strikes the portion of the racquet adjacent the frame or the frame itself.

Furthermore, a need exists to produce a racquet frame that will accept a recessed grommet formed with a continuous groove having a plurality of spaced ledges and slots useful in stringing the bed. Placing such formations as an integral construction, as shown in U.S. Pat. No. 5,743,822, raises difficulties in removal of a one-piece frame from a mold.

SUMMARY OF THE INVENTION

Accordingly, the above problems and difficulties are avoided by the present invention which provides a tennis racquet which includes a holeless oval frame head having a front and a back face provided with a continuous side edge groove and with spaced-apart grooves or recessed cuts which are used to receive a string therein as the string is trained to overlap in a longitudinal and transverse direction across both front and rear or back faces of the frame head. Specifically, spaced-apart and open-ended transverse slots are placed across the front and back surfaces of the front and back frame faces and the continuous side edge groove is provided about the outside of the frame head normal to the transverse slots. The outside peripheral edge of the frame further includes connecting grooves or slots that join in the terminating ends of the front and back face transverse slots. Agrommet is insertably received in the side edge groove and is suitably secured in place so as to occupy the entire length of the edge groove. The grommet includes a plurality of spaced-apart slots which are in coextensive alignment with the slots of the frame head. A continuous edge marginal groove is exposed when the grommet is assembled in the side edge groove of the frame head. The connecting grommet transverse slots and the edge marginal groove define a series of projections about which the racquet string is trained so as to crisscross over the central opening of the oval frame head. The projections defining the marginal edge groove include an under-cut channel mateable with the curvature of the string as the string bears against the projection. Therefore, a double stringed bed is provided with the string trained about the frame head in a recessed position so that the strings of the bed are substantially coplanar across the bed surface and slightly above the front and back faces of the frame head.

Therefore, it is among the primary objects of the present invention to provide a double string bed for a tennis frame head which will provide maximum control of a tennis ball even when the ball strikes the portion of the racket head frame adjacent to or on the frame itself.

Another object resides in providing a double stringed frame with the string being raised above the front and rear faces or surfaces of the frame head so that miss-hits of the ball adjacent the frame or even off of the frame per se will have a greater chance of being viable shots.

Still a further object of the present invention is to provide a novel racquet having a frame member forming a head portion with duplicate string ball-striking matrices and wherein each matrix is substantially raised above the respective front and rear face surface of the frame member.

Still a further object is to provide a stringed racquet of the double bed type without the need or use of holes in the frame or without the need or use of tubes which require installation on the frame.

A further object resides in providing a frame head and resilient grommet assembly permitting both components of the assembly to be individually molded and subsequently assembled.

Another object resides in providing a racquet frame having a slotted and grooved insert assembled with a rigid frame whereby a double stringed bed is constructed and the frame as well as the insert are separately molded.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
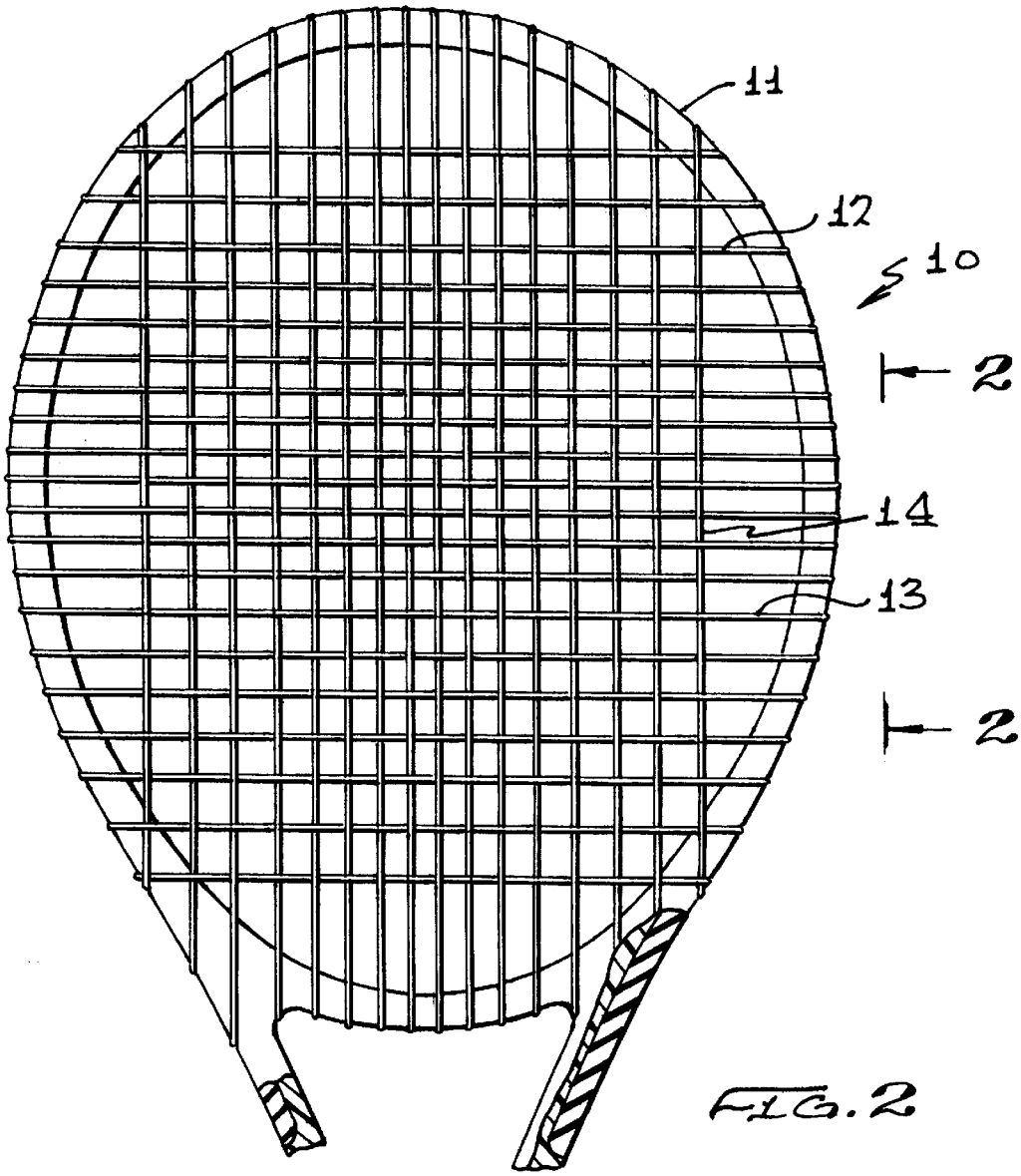
FIG. 1 is a front elevational view of a tennis racquet head employing a double string bed in accordance with the present invention.

Referring to FIG. 1, the inventive tennis racquet incorporating the present invention is indicated in the general direction of arrow 10 which includes a frame head 11 generally shaped as an oval with a central opening across which a plurality of string element runs are trained. The string element is indicated by numeral 12 and it can be seen that the total string bed comprises cross-over of the string runs in both a transverse direction, as represented by numeral 13, as well as in a longitudinal orientation, as indicated by numeral 14. The string element is a continuous filament which is initially carried on the frame head by means of forming a knotted loop and which is then strung about the peripheral edge of the frame head to terminate at its opposite end in a knotted loop. Where the loops terminate is not a part of the present invention and in some instances, the loop may terminate at the top of the frame head. It is to be particularly noted that the string bed is double sided so that the transverse and longitudinal arrangement of string element runs is duplicated on the other side of the frame head from that illustrated in FIG. 1. Therefore, the double stringed framed head incorporates a first side associated with one side of the frame head while the other string bed forms a string relationship on the opposite side. The runs of transverse and longitudinal runs are parallel to one another in the front elevational view between the two beds of string elements. Therefore, it can be seen that a double string frame head is provided and that the strings are trained over the edge of the frame head 11 and wound about the opposite side to form the other string bed. A handle or hand-grasping portion of the racquet downwardly depends from the frame head 11; however, the handle does not form a part of the present invention.

Figure 2:
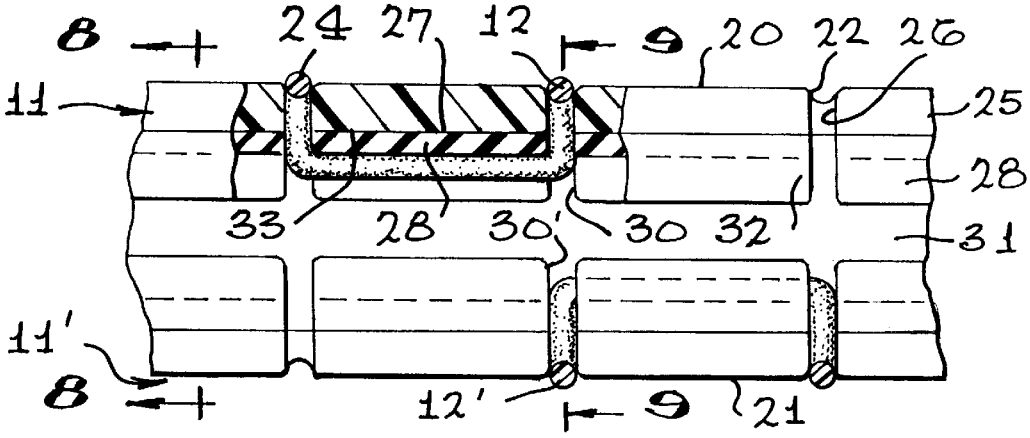
FIG. 2 is a greatly enlarged fragmentary side elevational view, partly in section, illustrating the stringing of a string element about the frame and grommet as used in the double bed string arrangement shown in FIG. 1.

Referring now to FIG. 2, an enlarged fragmentary view, partly in section, of the inventive frame head is illustrated in which numeral 11 represents one side of the frame while numeral 11' illustrates the other side of the frame between which runs of the string element 12 are trained. The runs of the string element provide a string bed on one side of the frame head, such as the string element indicated by numeral 12, while an additional run of the string element across the opposite side 11' of the frame head is indicated by numeral 12'. It can be seen that both the front face 20 and the rear face or back face 21 are provided with a plurality of transverse recessed cuts or slots, such as slot 22. The slots 22 are not only spaced-apart according to a regular dimension but are considered to be transverse or lateral slots which are open-ended and extend across the faces 20 and 21. Therefore, the string element 12 can be laid into the recessed cut or slot so that the string substantially occupies the slot and whereby a small portion of the string element diameter is permitted to protrude above the surface 20 or 21. The protruding portion is indicated by numeral 24 in FIG. 2. The outer exterior edge surface, such as indicated by numeral 25, is provided with a plurality of spaced-apart connecting grooves, such as connecting groove 26. A connecting groove accommodates training of the string element not only across the slot 22 but permits training the string element downwardly through the connecting groove 26.

A continuous edge groove 27 extends about the complete external edge surface 25 of the frame head 11. Groove 27 is illustrated as being occupied by an insertable resilient grommet 28 with grooves 30 and 30' communicating with connecting grooves 26 formed in the outer side edge 25 of the frame head. The grommet 28 further includes an open peripheral groove 31 extending along the full length of the grommet.

With reference to the figures, it can be seen that the slots 22 terminate with the connecting grooves 26 that in turn communicate with the grommet grooves 30 and 30' so that a portion of the grommet between adjacent grooves 30 define a projection, such as indicated by numeral 32 about which a portion of the string element is lopped or trained. The portion or projection 31 includes an under-surface 33 to accommodate the shape of the string element 12. It can be seen that the projections serve as lugs and that the under surfaces 33 of each of the respective projections or lugs 32 define the opposite sides of the continuous grommet edge groove 31. In other words, the exterior edge surface 25 which is divided between a first row of lugs and a second row of lugs and so forth. Therefore, it can be seen that as the string element 12 is trained through the respective slots 22, the string element then progresses through the grooves 26 and 30 and is then looped around the adjacent lug through the next adjacent groove associated with the continuous groove 31 and then the string element is turned upward through the next groove 26 and reversed to be trained through the associated slot 22 for a run across the opening of the frame head to the opposite frame 11.

Figure 3:
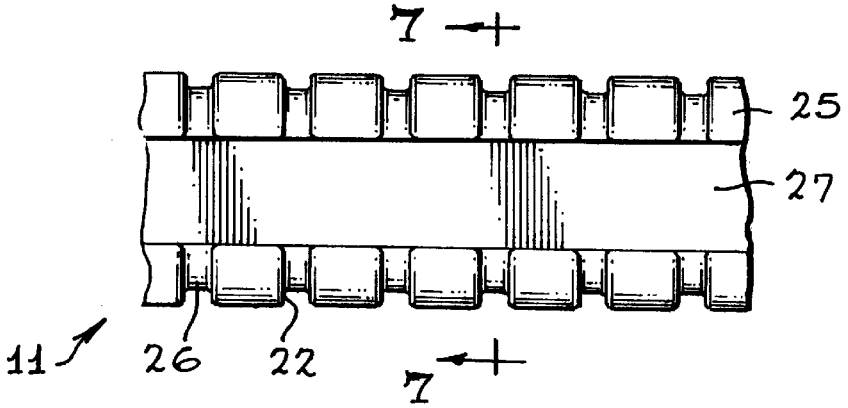
FIG. 3 is a fragmentary side elevational view of the frame illustrating the continuous side edge groove without the grommet.
Figure 4:
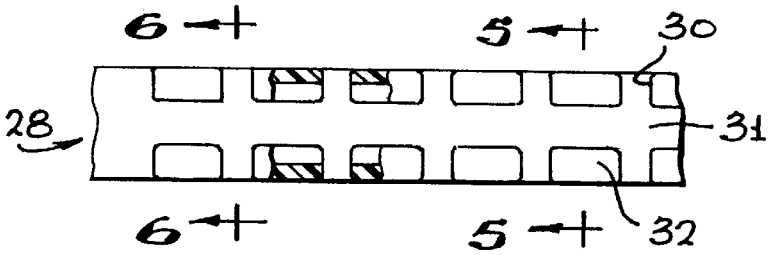
FIG. 4 is a fragmentary side elevational view of the grommet, partly in section, illustrating the grommet preparatory for assembly with the frame as shown in FIG. 3.

FIG. 3 illustrates the frame head 11 without the grommet 28. It can be seen that the external or outer peripheral edge of the frame head includes a continuous channel or groove 27 intended to insertably receive the grommet 28. Also, it can be seen that the transverse slots 22 merge with the connecting grooves 26. In FIG. 4, the grommet is illustrated having a continuous channel or groove 31 on its outer edge and further including connecting grooves 30 which coextend from the connecting grooves 26 in the frame head. Adjacent grooves 30 define a plurality of projections 32 under which loops of the string are placed in order to form the double string beds.

Figure 5:
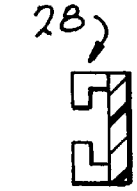
FIG. 5 is a transverse cross-sectional view of the grommet shown in FIG. 4 as taken in the direction of arrows 5—5.
Figure 6:
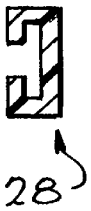
FIG. 6 is a view similar to the view of FIG. 5 as taken in the direction of arrows 6—6 of FIG. 4.
Figure 7:
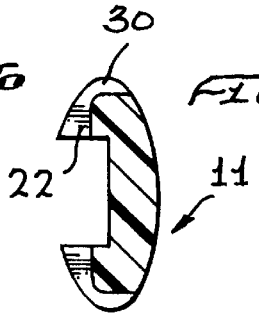
FIG. 7 is a transverse cross-sectional view of the frame head shown in FIG. 3 as taken in the direction of arrows 7—7 thereof.
Figure 8:
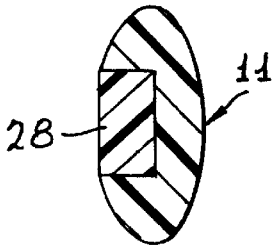
FIG. 8 is a transverse cross-sectional view of the frame head and grommet assembly taken in the direction of arrows 8—8 of FIG. 2.

FIG. 5 illustrates the grommet while FIG. 7 is a cross-sectional view of the frame head illustrating the grooves and slots. In FIG. 8, a transverse cross-section of the assembled grommet and frame head is illustrated.

Figure 9:
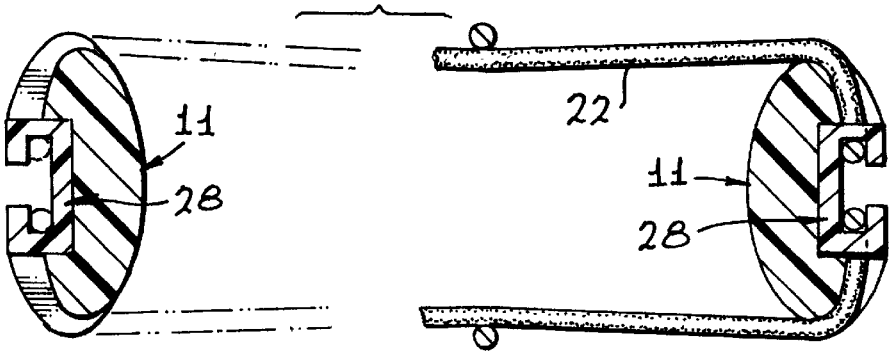
FIG. 9 is an exploded transverse cross-sectional view of the string bed, grommet and frame head as illustrated in FIG. 2 in the direction of arrows 9—9 thereof.

As illustrated in FIG. 9, the loops of the respective string elements or the opposite ends of the runs are looped underneath the lugs or projections 32 of the grommet and are trained or interwoven in a crisscross arrangement across the opening of the oval frame head.

Therefore, it can be seen that the inventive tennis racquet frame head of the present invention provides double matrices of crisscrossing string element beds so that the string element forms a continuous surface of ball striking area wherein the ball may be induced to provide spin and drop shots and particularly prevent frame hits. The use of the inventive frame head creates different types of spin serves as well as better touch on drop shots. Also, other tennis shots, such as top spin or under spin forces placed on the ball are greatly enhanced. Construction of the inventive tennis racquet is not labor intensive since a multiplicity of holes or installation of tubes is not necessary. Even in the event of hole usage, it is labor intensive to continually insert the string element through each of the respective holes in order to mount the string in proper location.

The grommet is separately fabricated from the frame head and both can be done using molding techniques. No difficulty is encountered in removing or separating the grommet or the frame head from its separate mold.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A double stringed racquet comprising:

a racquet frame having an oval frame head with a central opening defined by an encircling hole-less frame;

said frame having front and back faces with a plurality of spaced-apart lateral grooves across said faces of said frame and a continuous peripheral edge groove communicating said lateral grooves;

a plurality of lugs defined between adjacent spaced-apart lateral grooves and terminating with said continuous peripheral edge groove;

an endless grommet insertably receivable in said edge peripheral groove and said grommet having spaced-apart slots in a co-extensive relationship with said lateral grooves;

said grommet further having a plurality of spaced-apart projections constituting lugs which include an undercut channel;

a string element trained across said frame head opening in a crisscross pattern to provide a double stringed frame head;

a portion of said string element occupying each of said lateral grooves protruding beyond said front and back faces of said frame; and said string element further being trained about said plurality of lugs and terminating in securement loops at its opposite ends with said frame.

2. The racquet as defined in claim 1 wherein:

each of said lugs of said grommet is provided with an arcuate undercut channel between adjacent connecting slots of said grommet in communication with a grommet edge marginal groove for engagement with said string element in conformal relationship.

3. A double stringed racquet comprising:

a frame head having opposite sides defining a central opening;

a string element trained on said frame head to provide a double bed of said string element;

said frame head having a continuous edge groove;

a continuous grommet disposed in said continuous edge grove and having a plurality of lugs providing a first row and a second row separated by a continuous open peripheral groove;

said string element trained about each of said lugs to provide a pair of string beds separated by said central opening; and portions of said string element appearing and exposed beyond said frame head and said grommet so as to prevent engagement of a ball with said frame head.

4. The racquet as defined in claim 3 wherein:

said frame head and said grommet are provided with a plurality of lateral grooves and connecting slots communicating with said peripheral groove for conducting said string element about said respective lugs.

5. The racquet defined in claim 4 wherein:

said connecting slots are arranged in fixed, spaced-apart relationship along said opposite sides of said frame head;

said lateral grooves are arranged in fixed, spaced-apart relationship along said endless grommet; and each connecting slot being co-extensive with an associated lateral groove so as to accommodate disposition of each of said portions of said string elements in a linear and parallel relationship with respect to adjacent ones of said string elements.

6. The racquet defined in claim 5 wherein:

said grommet is fixly attached within said continuous edge groove to said frame head.

7. The racquet defined in claim 6 wherein:

said grommet is composed of a semi-rigid material.

8. The racquet defined in claim 6 wherein:

said first row of lugs and said second row of lugs are disposed in fixed, spaced-apart relationship and are separated by a continuous opening defined between opposing ends of said lugs.

9. The double stringed racquet comprising:

a frame head having opposite front and back surfaces;

said frame head having a continuous edge groove;

a grommet occupying said edge groove;

said grommet having a peripheral open groove disposed between said front and back surfaces;

a plurality of lugs carried on said grommet arranged in opposing rows and separated by an exposed portion of said peripheral groove;

a plurality of slots provided on said front and back surfaces across said frame head and said grommet connecting with said peripheral open groove and defining each of said lugs between adjacent ones of said slots; and a string trained on said frame head in said slots and trained about each of said lugs to provide a double stringed bed.

* * * * *